US006286325B1

(12) United States Patent
Chiu et al.

(10) Patent No.: US 6,286,325 B1
(45) Date of Patent: Sep. 11, 2001

(54) EVAPORATIVE CONDENSING APPARATUS

(75) Inventors: Peng-Chu Chiu; Tsui-Ling Hsuen, both of Hsinchu; Chih-Hsien Huang, Hsinchu Hsien, all of (TW)

(73) Assignee: Nutec Electrical Engineering Co., Ltd., Taipei (TW)

( * ) Notice: Subject to any disclaimer, the term of this patent is extended or adjusted under 35 U.S.C. 154(b) by 0 days.

(21) Appl. No.: 09/571,729

(22) Filed: May 15, 2000

Related U.S. Application Data

(63) Continuation-in-part of application No. 09/168,940, filed on Oct. 9, 1998.

(51) Int. Cl.[7] ..... F28D 3/00
(52) U.S. Cl. ..... 62/171
(58) Field of Search ..... 62/171, 132, 271, 62/304, 183, 305, DIG. 17; 261/121, 140.2; 165/113

(56) References Cited

U.S. PATENT DOCUMENTS 3,785,064 * 1/1974 Thomas ..... 35/13
4,340,114 * 7/1982 Levy ..... 165/110
4,653,581 * 3/1987 Yogo et al. ..... 165/166
4,872,578 * 10/1989 Fuerschbach et al. ..... 165/167
5,125,453 * 6/1992 Bertrand et al. ..... 165/153
5,752,566 * 5/1998 Liu et al. ..... 165/110
5,755,113 * 5/1998 Ferguson et al. ..... 62/474
6,179,051 * 1/2001 Ayub ..... 165/167

* cited by examiner

*Primary Examiner*—Teresa Walberg
*Assistant Examiner*—Daniel Robinson
(74) *Attorney, Agent, or Firm*—Rosenberg, Klein & Lee

(57) ABSTRACT

An evaporative condensing apparatus used in an air conditioner to reduce the power consumption of the condenser and improves its EER value. The evaporative condensing apparatus is based on the rule that the relative critical pressure needed to condense a cooling medium is directly proportional to the temperature during the exchange of a cooling medium between gas state and liquid state. The evaporative condensing apparatus includes an evaporative condensing unit for condensing a gas state cooling medium into a liquid state, having a plurality of condenser coils and a layer of absorptive material covered on the condenser coils, a low compressor controlled to compress a gas state cooling medium into a liquid state in the evaporative condensing unit, an intermittent water supply system having a control PC board and an electromagnetic valve controlled by the control PC board to let cooling water be delivered from a water source to the layer of absorptive material of each condenser coil, and a condenser fan controlled to draw currents of air through gaps in the condenser coils of the evaporative condensing unit in carrying heat away from the evaporative condensing unit.

6 Claims, 15 Drawing Sheets

PIANO SW. SETTING

| 1 | 2 | 4 | 8 | t (SEC) |
|---|---|---|---|---|
| ■ | □ | □ | □ | 1 |
| □ | ■ | □ | □ | 2 |
| ■ | ■ | □ | □ | 3 |
| □ | □ | ■ | □ | 4 |
| ■ | □ | ■ | □ | 5 |
| □ | ■ | ■ | □ | 6 |
| ■ | ■ | ■ | □ | 7 |
| □ | □ | □ | ■ | 8 |
| ■ | □ | □ | ■ | 9 |
| □ | ■ | □ | ■ | 10 |
| ■ | ■ | □ | ■ | 11 |
| □ | □ | ■ | ■ | 12 |
| ■ | □ | ■ | ■ | 13 |
| □ | ■ | ■ | ■ | 14 |
| ■ | ■ | ■ | ■ | 15 |

FIG.4A

EVAPORATIVE CONDENSING APPARATUS

This application is a continuation-in-part of Applicant's application Ser. No. 09/168,940, filed Oct. 9, 1998.

BACKGROUND OF THE INVENTION

The present invention relates to an evaporative condensing apparatus for use in an air conditioner (cooler), and more particularly to such an evaporative condensing apparatus which greatly improve the working efficiency of the air conditioner (cooler).

Air conditioners (coolers) are intensively used in most countries in summer for air-conditioning buildings, rooms, trains, cars, etc. When an air conditioner is operated, it consumes much energy due to a high pressure compressor is used in a cooling medium system. The energy saving problem may do nothing wit mid-east contries or other patroleum producing contries, but it is very serious in most area of the world lack of energy source especially in summer time while a huge amount of air conditioners are used. In a regular air conditioner, a liquid state cooling medium is guided to a medium coil of an evaporator to make a heat exchange with air, permitting cooling air to be guided into the inside space of a building, room, train or car. After this heat exchange process, the liquid state cooling medium is changed into a gas state, the gas state cooling medium is then compressed by a compressor to a certain high pressure and pumped to the medium coils of a condenser where the gas state cooling medium is returned to the liquid state again due to a temperature dropping by a cooling system. In which, the lower temperature can be reached, the lower relative critical pressure is needed and then a low pressure compressor can be employed for energy saving. FIG. 1 shows a liquid-gas curve obtained form R-22 cooling medium. As indicated the cooling medium can easily be condensed with low relative pressure when at a low temperature, for example: when at 45° C. as point C of the curve, which is almost a lowest temperature the a conventional condensing unit can reach to, in which the relative critical pressure needed for condensing the medium is about 18 kg/cm$^2$, if the temperature can be dropped to 30° C. as point B, by a high efficient cooling system the relative critical pressure needed for condensing will be drastically reduced to 12.27 kg/cm$^2$. Therefore, the energy consumption of an air conditioner is reverse proportion to the efficiency of the cooling system used in the condensing unit.

Further, the cooling systems of conventional condenser include three types, namely, the air cooling type, the water cooling type and the evaporative type. An air cooling type condenser uses convention currents of air to carry heat away from its condensing coils. In order to let heat be quickly carried away, much air contact surface and high currents of air are needed. Therefore, an air cooling type condenser is heavy, consumes much energy, and produces high noise during its operation. A water cooling type condenser uses cooling water to carry heat away from its condensing coils. However, a water cooling type condenser is expensive, and consumes much cooling water. Further, the installation of a water tower for a water cooling type condenser is complicated, and may cause an American veteran syndrome. An evaporative type air conditioner dissipates heat by means of evaporation of water which is sprayed continuously on to the surface of the medium coil. Theoretically one liter of water absorbs about 539 cal. Evaporating latent heat when evaporated. Therefore the heat dissipation effect of an evaporative type is much better than an air cooling type and a water cooling type. However, when a conventional evaporative type condenser is used, it still has two disadvantages, firstly, the spraying water can not be held on a smooth surface of a bare metal condensing coil for an enough period of time to let the water getting fully evaporated, it will flows off from the condensing coils before evaporated. Therefore the heat dissipation effect is not fully developed, it can't do much better than the other two types; secondary, a large water storage means is needed to collect waste water that is not evaporated at the evaporative condensing unit of the air conditioner.

SUMMARY OF THE INVENTION

The present invention has been accomplished to provide an evaporative condensing apparatus for an air conditioner which eliminates the aforesaid drawbacks.

It is one object of the present invention to provide an evaporative condensing apparatus which enables supplied cooling water to be fully evaporated so that heat can be efficiently carried away during its operation.

It is another object of the present invention to provide an evaporative condensing apparatus which is compact, has all in it, and can conveniently be installed in an air conditioner.

According to one aspect of the present invention, the evaporative condensing apparatus comprises an evaporative condensing unit for condensing a gas state cooling medium into a liquid state, the evaporative condensing unit having a plurality of condenser coils and absorptive means covered on the condenser coils, a water supply system having a control PC board which automatically adjusts an intermittent period of water supplying according to a temperature signal taken from the condensing coil by a thermal sensor and an electromagnetic valve controlled by the control PC board to let cooling water be delivered intermittently from a water source to the layer of absorptive material of each condenser coil, a compressor of comparable low pressure controlled to provide an adequate pressure for delivering the gas state cooling medium into the condensing unit and to condense the medium into liquid state thereat. And a condenser fan controlled to draw currents of air through gaps in the condenser coils of the evaporative condensing unit in carrying the evaporated moisture and heat away from the evaporative condensing unit.

According to another aspect of the present invention, the condenser coils each comprise a metal coil tube and a layer of absorptive material covered on the periphery of the metal coil tube, and the water supply system comprises a plurality of water spray tubes and absorptive material covered on the water outlets of the water spray tubes for permitting supplied cooling water to be evenly smoothly distributed to the absorptive material at the condenser coils.

BRIEF DESCRIPTION OF THE DRAWINGS

FIG. 4A shows how a piano switch as shown in FIG. 4 to set the water supply period from 1 sec. to 15 sec.

DETAILED DESCRIPTION OF THE PREFERRED EMBODIMENT

Figure 2:
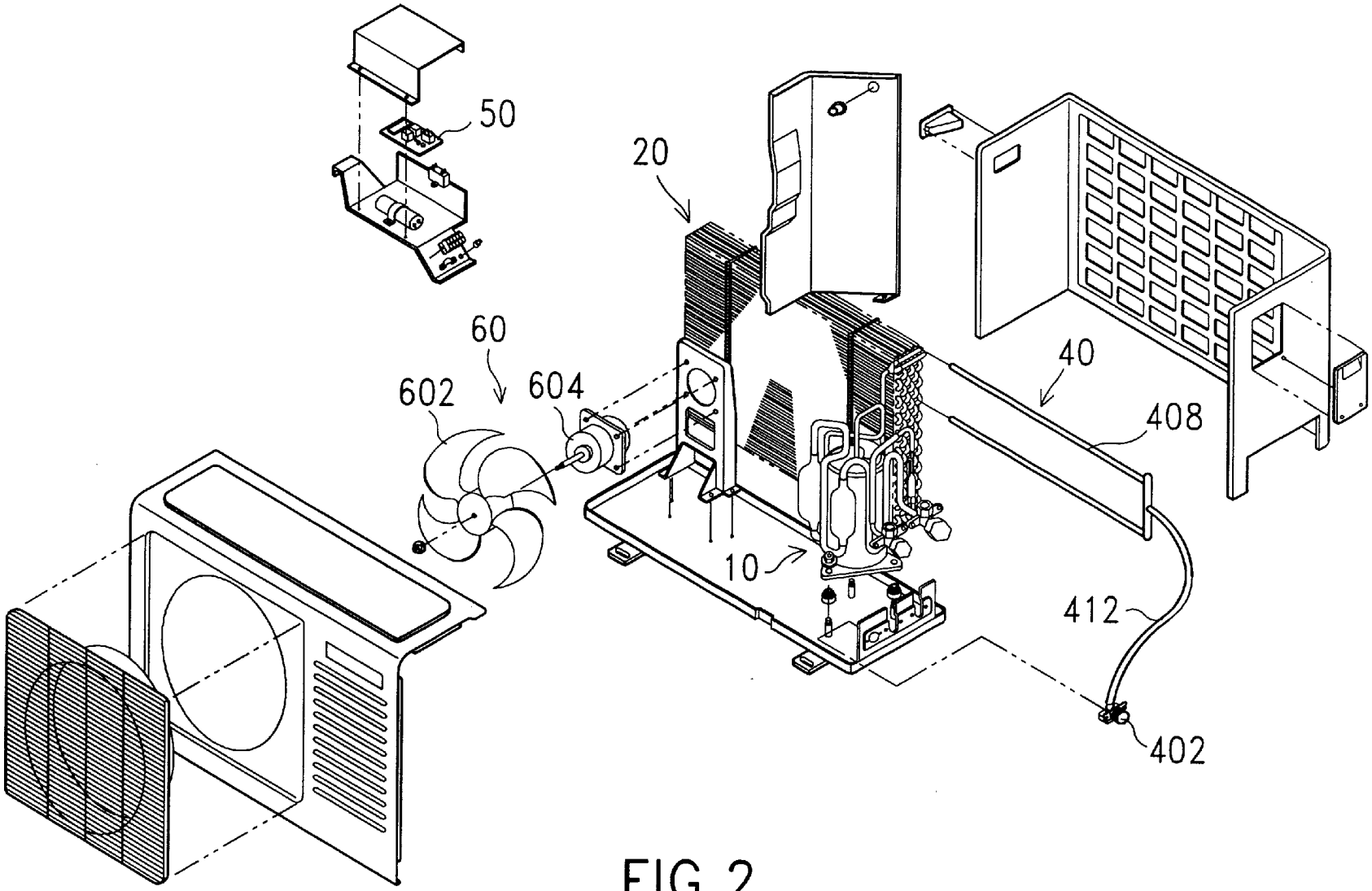
FIG. 2 is an exploded view of an air conditioner constructed according to the present invention.
Figure 3:
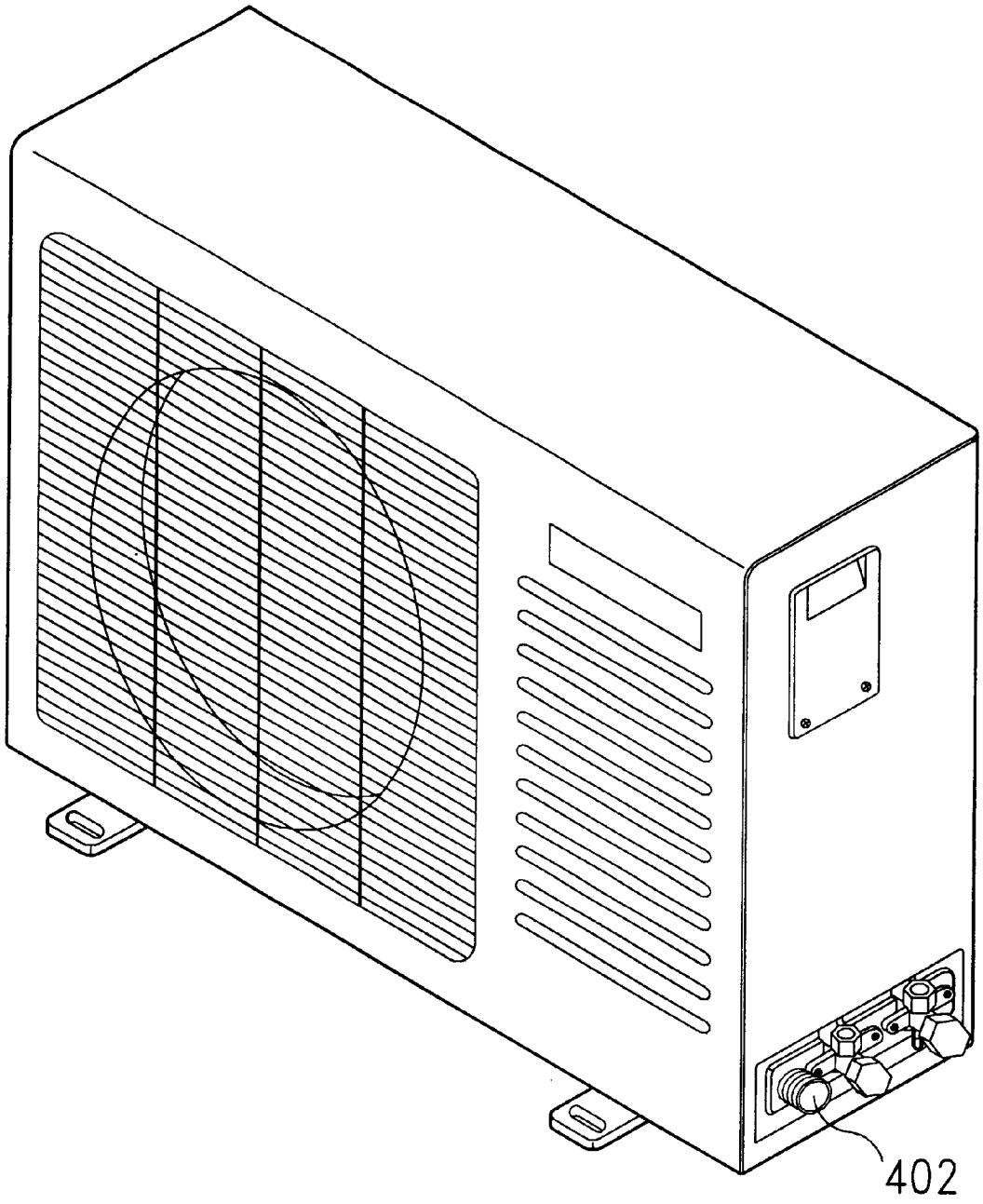
FIG. 3 is an elevational view of the air conditioner shown in FIG. 2.
Figure 4:
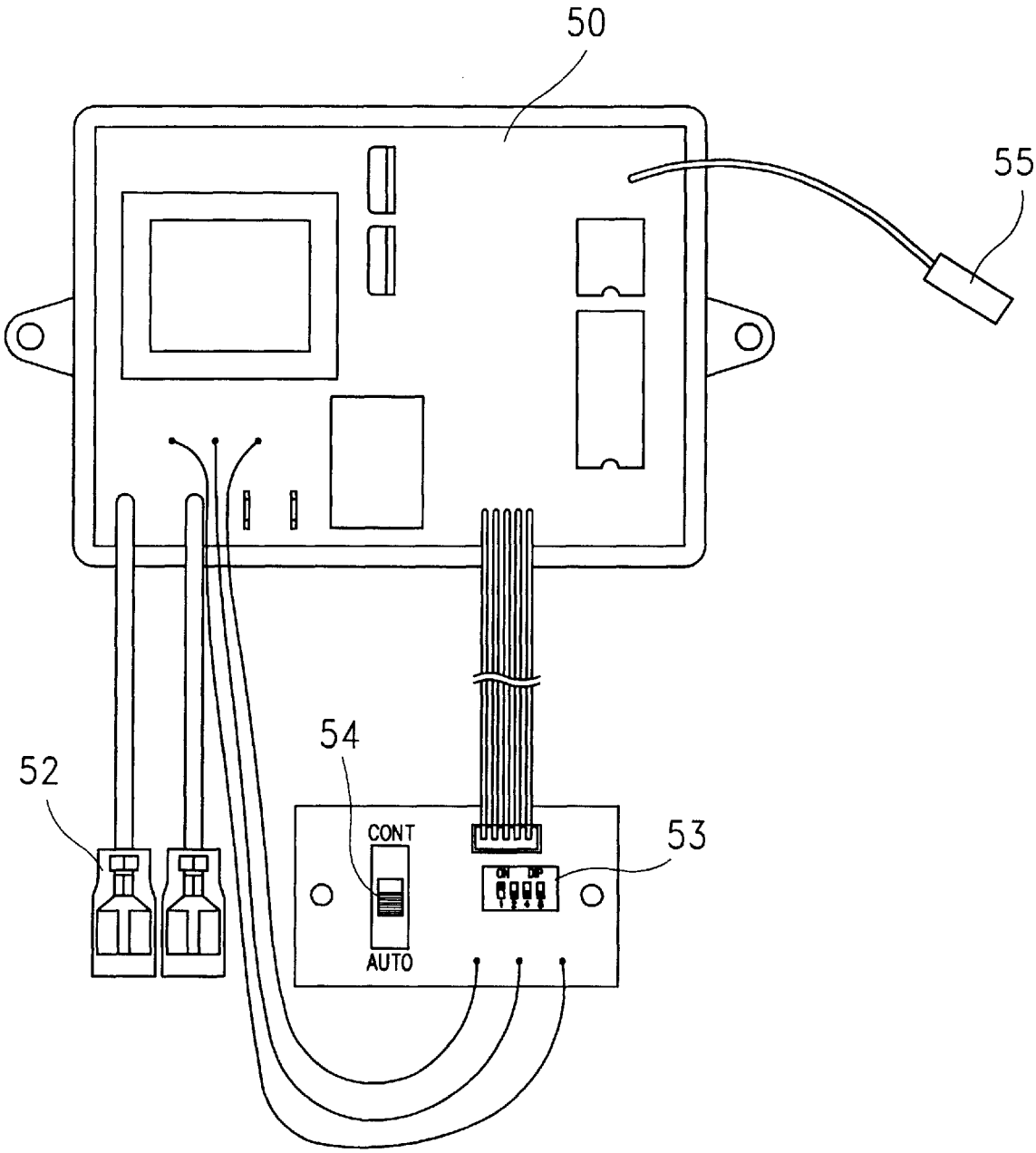
FIG. 4 is a plan view of a PC board according to the present invention.

Referring to FIGS. 2 and 3, an evaporative condensing apparatus comprises a compressor 10 is operated to pump a high pressure high temperature gas state cooling medium into an evaporative condensing unit 20, permitting it to be condensed into liquid state. A water supply system 40 is controlled by a control PC board 50 to control an electromatic value 402 for intermittently supplying water to the absorptive material 202 (see FIGS. 6 and 7) respectively covered on a plurality of condensing coils 204 (FIGS. 6 and 7) of the evaporative condensing unit 20. A condenser fan 60 which is comprised of a fan motor 604 and a fan blade unit 602 is controlled to causes currents of air through air passages in the evaporative condensing unit 20, causing heat and moisture to be quickly carried away from the evaporative condensing unit 20.

Referring to FIGS. 4,4A,5,5A and 5B, the PC board 50 comprises a CPU 51; a power supply connector 52; a piano switch 53 for setting a predetermined period of time of water supplying from 1 sec. to 15 sec. (see FIG. 4A) according to the capacity of the air conditioner referred to the instruction of the manufacturer, for example, a two tons air conditioner may need to set 7 sec., and a one ton air conditioner may need 4 sec.; a select switch 54 having an "auto" position for normal operation and a "cont."(continuous) position for cleaning the unit only; a thermal sensor 55 for detecting the medium temperature in the condensing unit 20; and an output(load) line 56 for automatically controlling the close/open operation of the electromagnetic valve 402.

Figure 1:
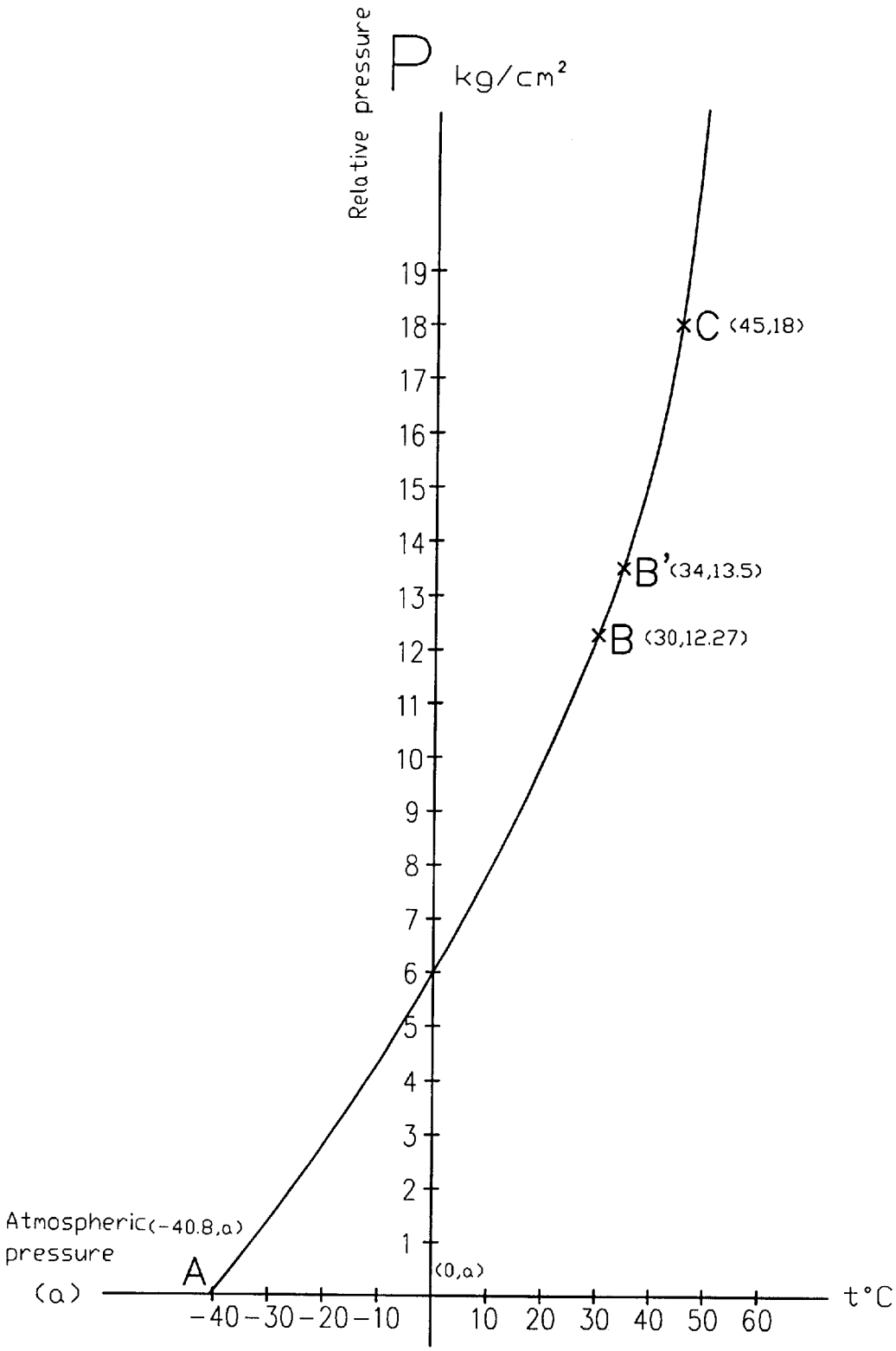
FIG. 1 is a liquid-gas curve obtained from R-22 cooling medium.
Figure 5:
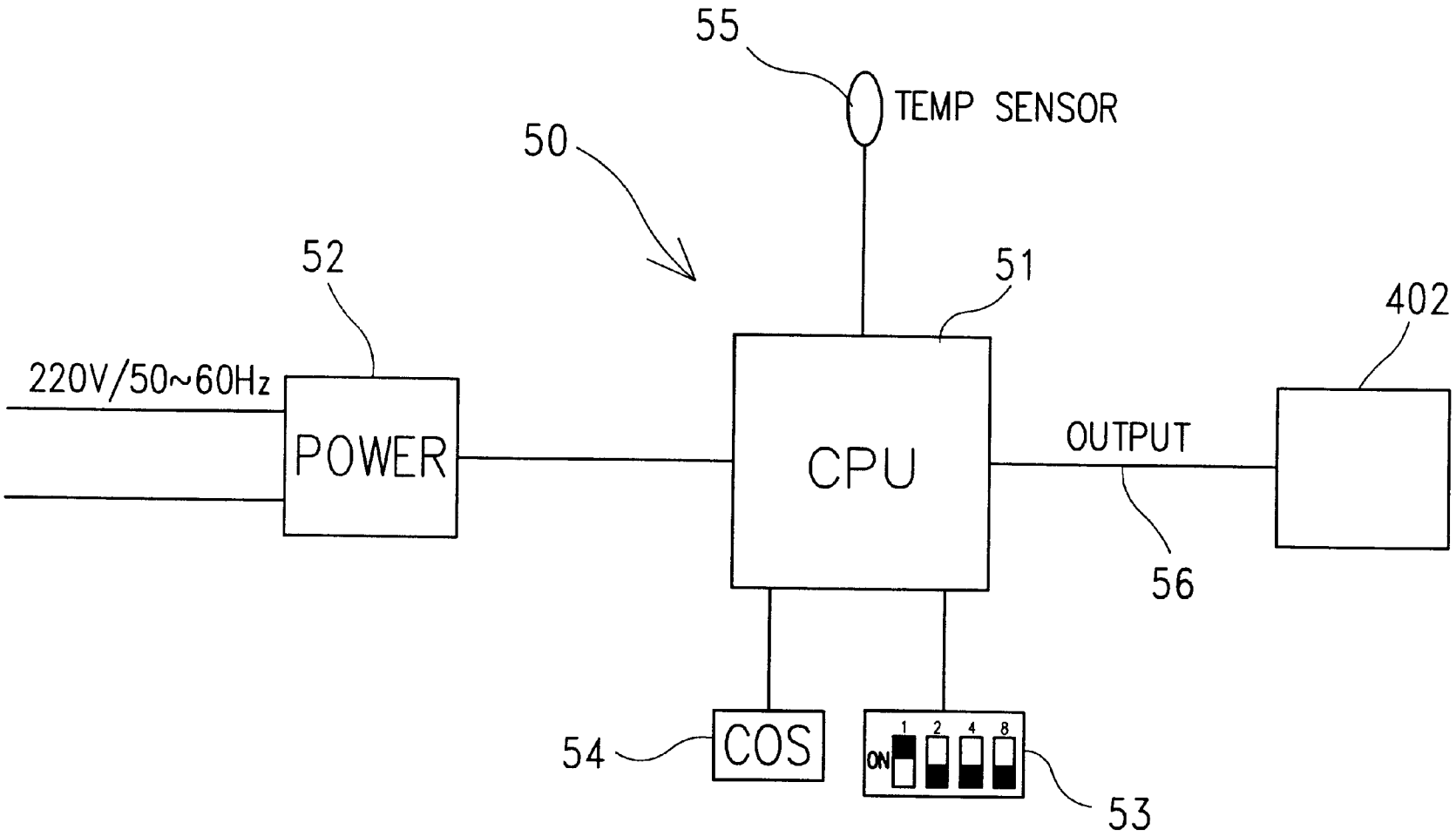
FIG. 5 is a block diagram of FIG. 4.
Figure 5A:
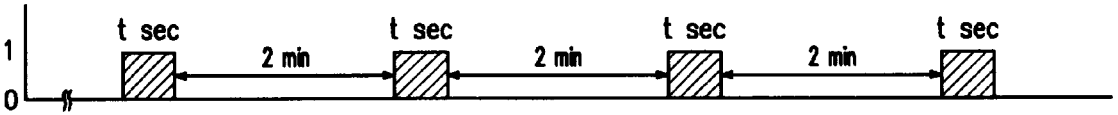
FIG. 5A shows a regular intermittent water supplying statement according to the present invention.
Figure 5B:
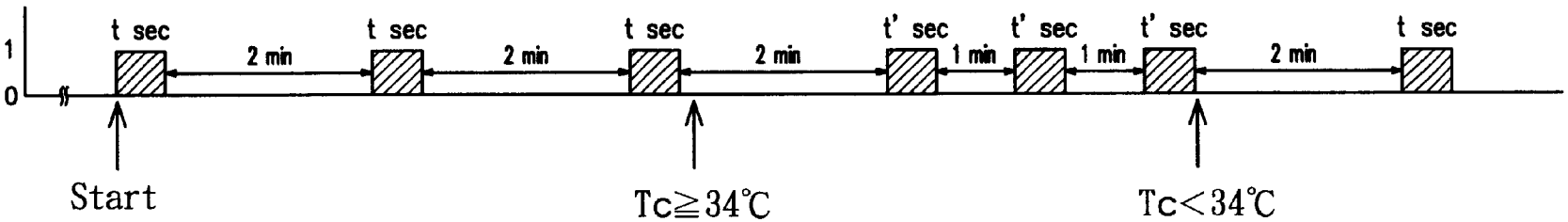
FIG. 5B shows an irregular intermittent water supplying statement which the intermittence is automatically adjusted under the control of the PC board.

When in normal operation after a proper water supplying time of "t" sec. being set by the piano switch 53, and the select switch 54 being selected at the "auto" position, the CPU 51 of the PC board 50 will automatically operates the electromagnetic valve to open for "t" sec. once alternatively after a predetermined regular intermittence say two minutes for instance as shown in FIG. 5A. In which, the intermittent time of two minutes is assumed that the amount of water supplied to the absorptive material 202 covered on the condensing coils 204 in a "t" second period will be approximately fully evaporated within the controlled intermittence to provide a highest effect for absorbing latent heat from the cooling medium for obtaining an ideal setting temperature around 34° C. (point B' in FIG. 1). In case of a temperature signal fed back from the thermal sensor 55 is exceeded 34° C. as show in FIG. 5B the CPU 51 will automatically reduce the intermittence to a predetermined substitution say one minute for example and automatically increase the water supplying period of "t" sec. To a preferable period of "t'" sec., until when the temperature is dropped back to the ideal setting of 34° C., the intermittence will be automatically reset to two minutes by the CPU 51 so as to maintain a constant temperature of 34° C. therefore.

It is clear that the main characterization of the present invention is not only by using of absorptive material 202 covered on the condensing coils 204 but also by using an intermittent water supplying system 40 to let the water (which is held in the absorptive material) having enough time to fully evaporated.

Figure 6:
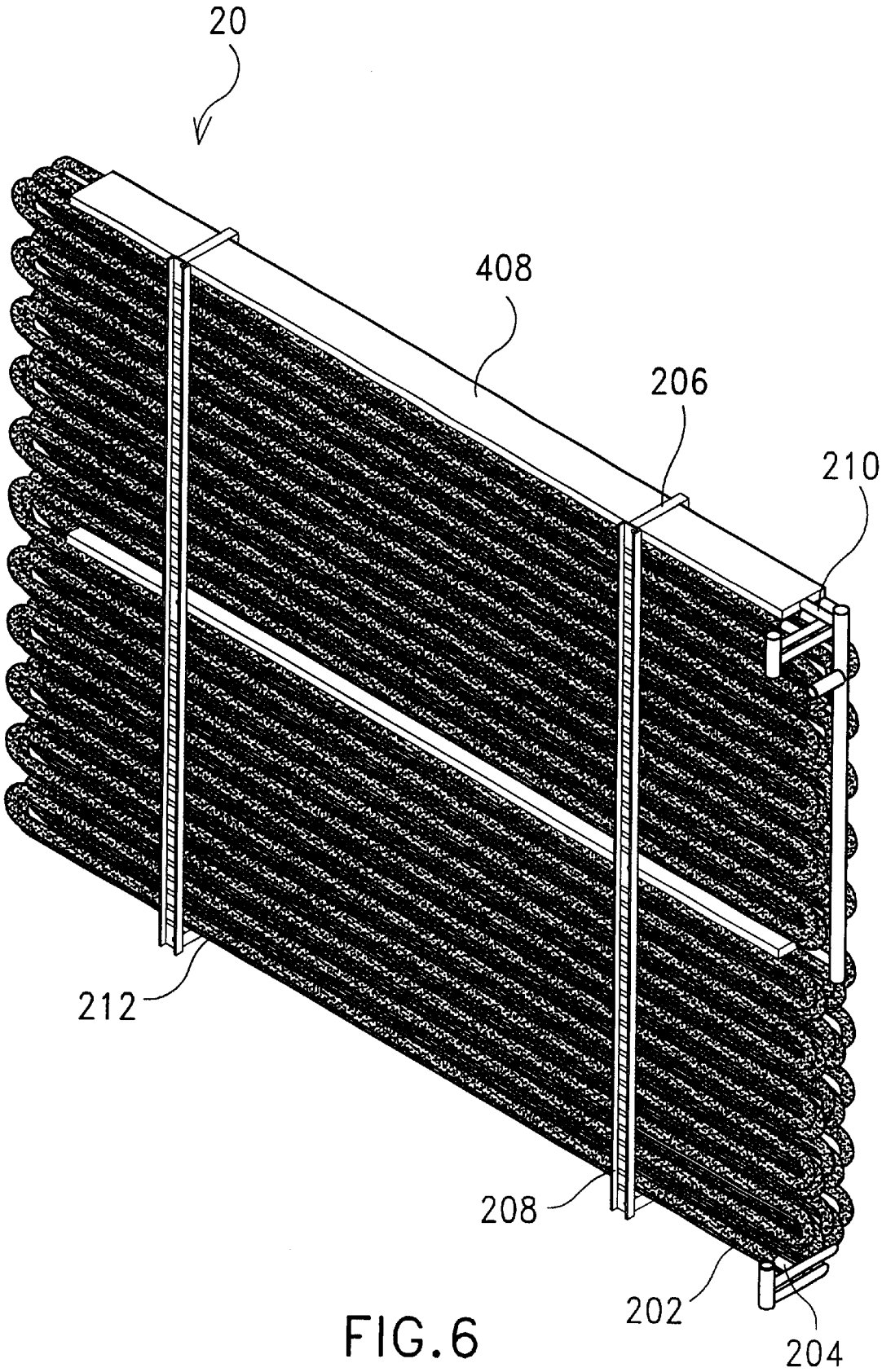
FIG. 6 is a perspective view of an evaporative condensing unit according to the present invention.
Figure 7:
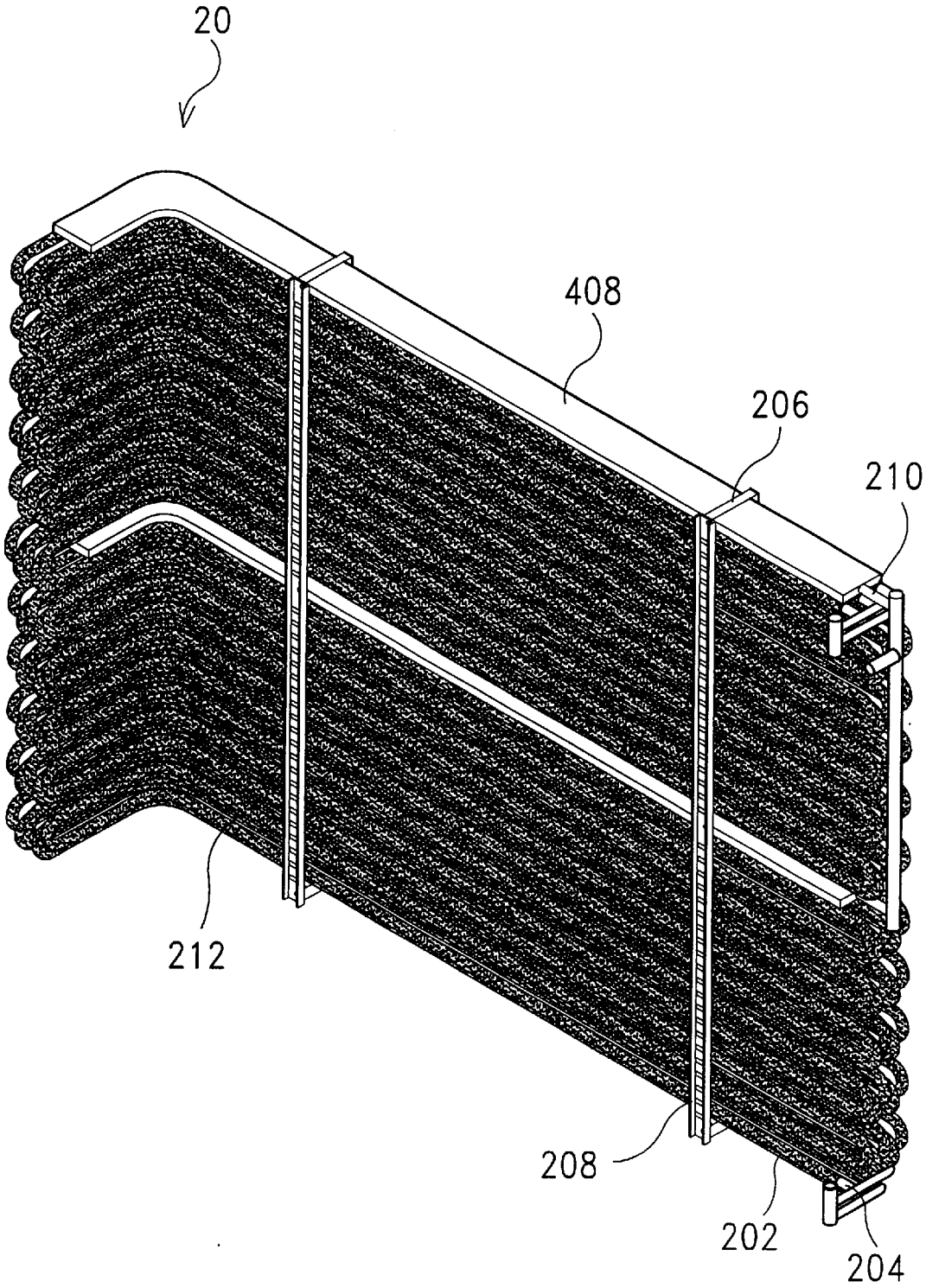
FIG. 7 is a perspective view of an alternate form of the evaporative condensing unit according to the present invention.
Figure 8:
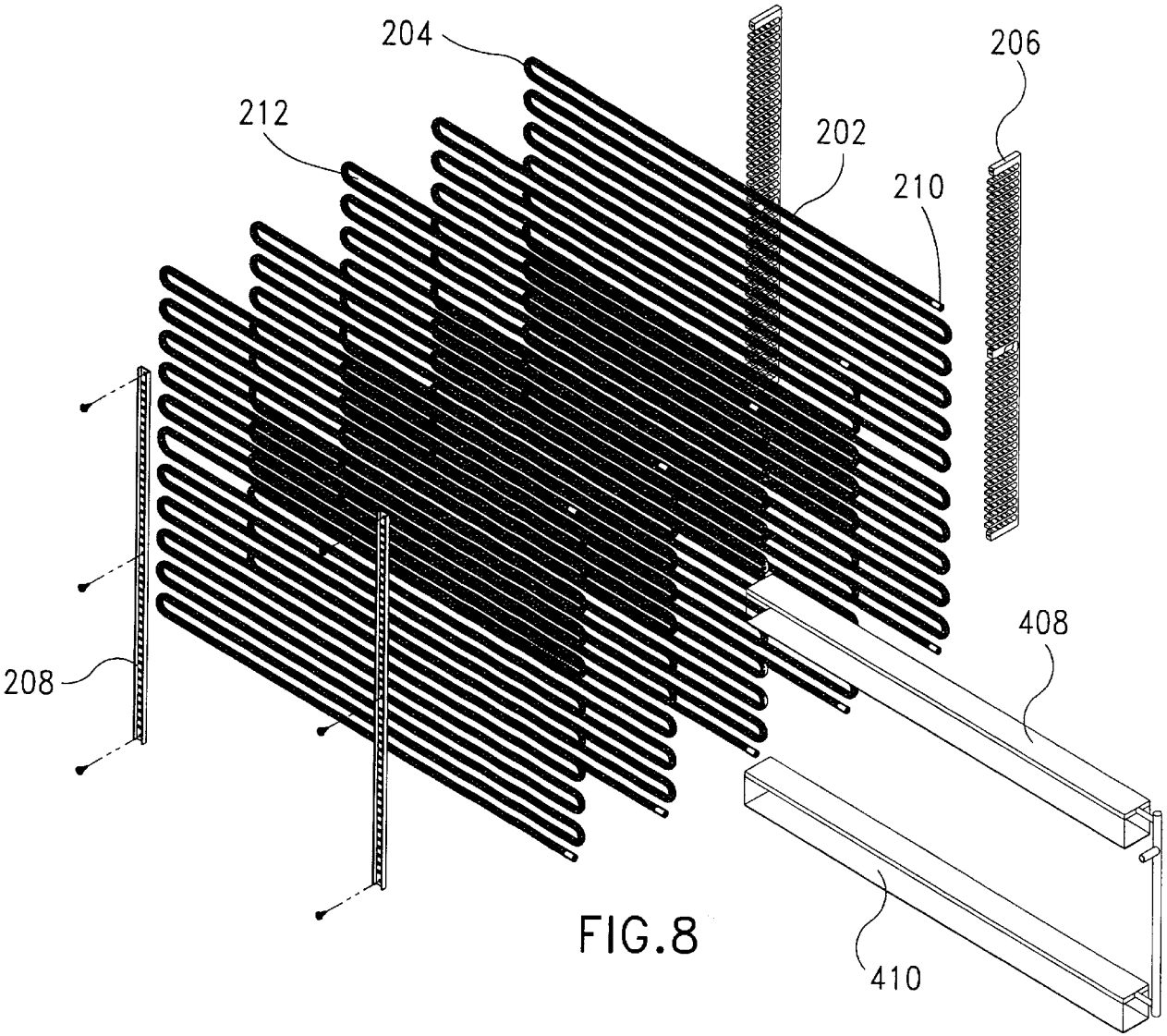
FIG. 8 is an exploded view of the evaporative condensing unit shown in FIG. 6.

Referring to FIGS. 6,7 and 8, the evaporative condensing unit 20 can be formed of a straight shape as shown in FIG. 6, or a curved shape as shown in FIG. 7. The evaporative condensing unit 20 is comprised of a plurality of supporting frames 206, a plurality of independent condenser coils 204 fastened to the supporting frames 206 and arranged in parallel or a staggered manner for circulation of a cooling medium, the condenser coils 204 being respectively covered with absorptive material 202 and defining a plurality of air gaps 212 between sections thereof, a plurality of packing frames 208 respectively fastened to the supporting frames 206 by screws to secure the condenser coils 204 and the supporting frames 206 together. Further, the water spray tubes 408 of the water supply system 40 (see also FIG. 2) are respectively fastened to the supporting frames 206 at different elevations, and controlled to spray water over the condenser coils 204. The water spray tubes 408 are respectively covered with absorptive material 410, so that sprayed water can be absorbed by absorptive material 410 and then evenly smoothly distributed over the condenser coils 204.

Figures 9, 9A:
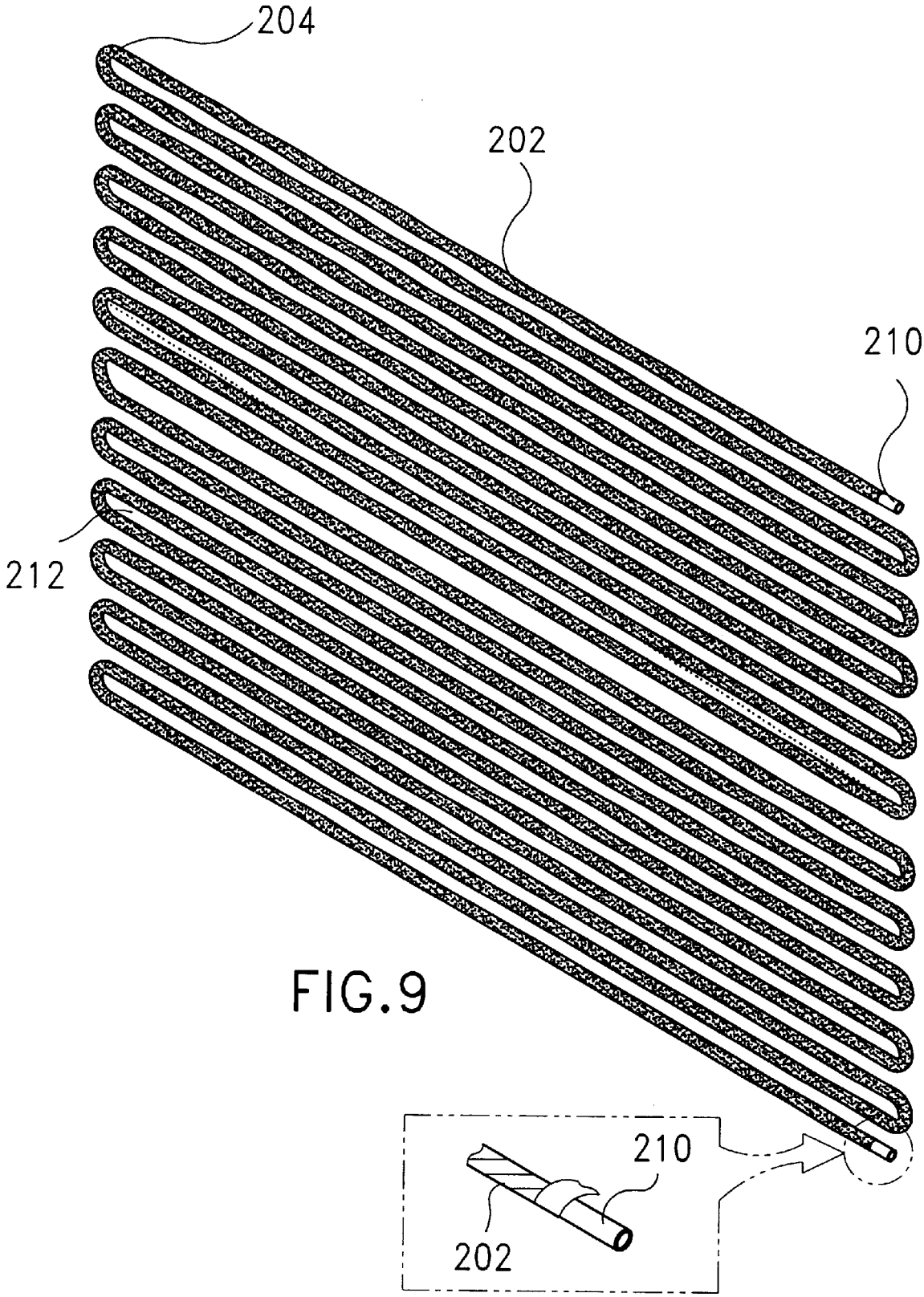
FIG. 9 is a perspective view of a condenser coil according to the present invention.
FIGS. 9A and 9B are enlarged views showing different method for covering the absorptive material onto the condensing coil.
Figure 9B:
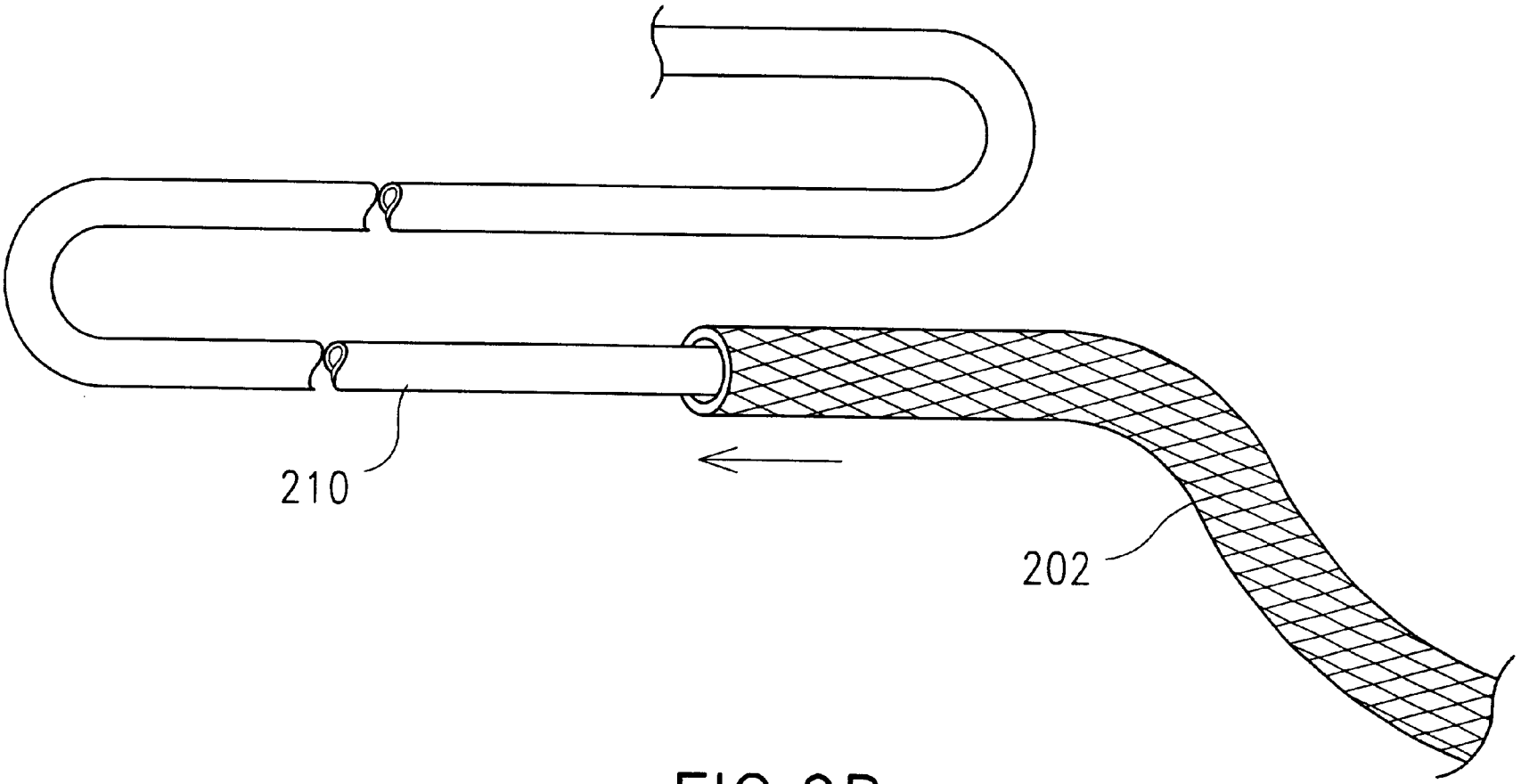

Referring to FIGS. 9 and 9A, the condenser coil 204 is comprised of a metal coil tube 210 and a tape of absorptive material 202 spirally wound round the metal coil tube 210. Alternatively, the absorptive material 202 can be made in the form of a sleeve tube and slipped onto the condenser coil 204 freely as shown in FIG. 9B. The absorptive material 202 can be obtained from non-woven cloth, cloth, natural fibers, synthetic fibers, reclaimed fibers, inorganic fibers, etc.

Figure 10:
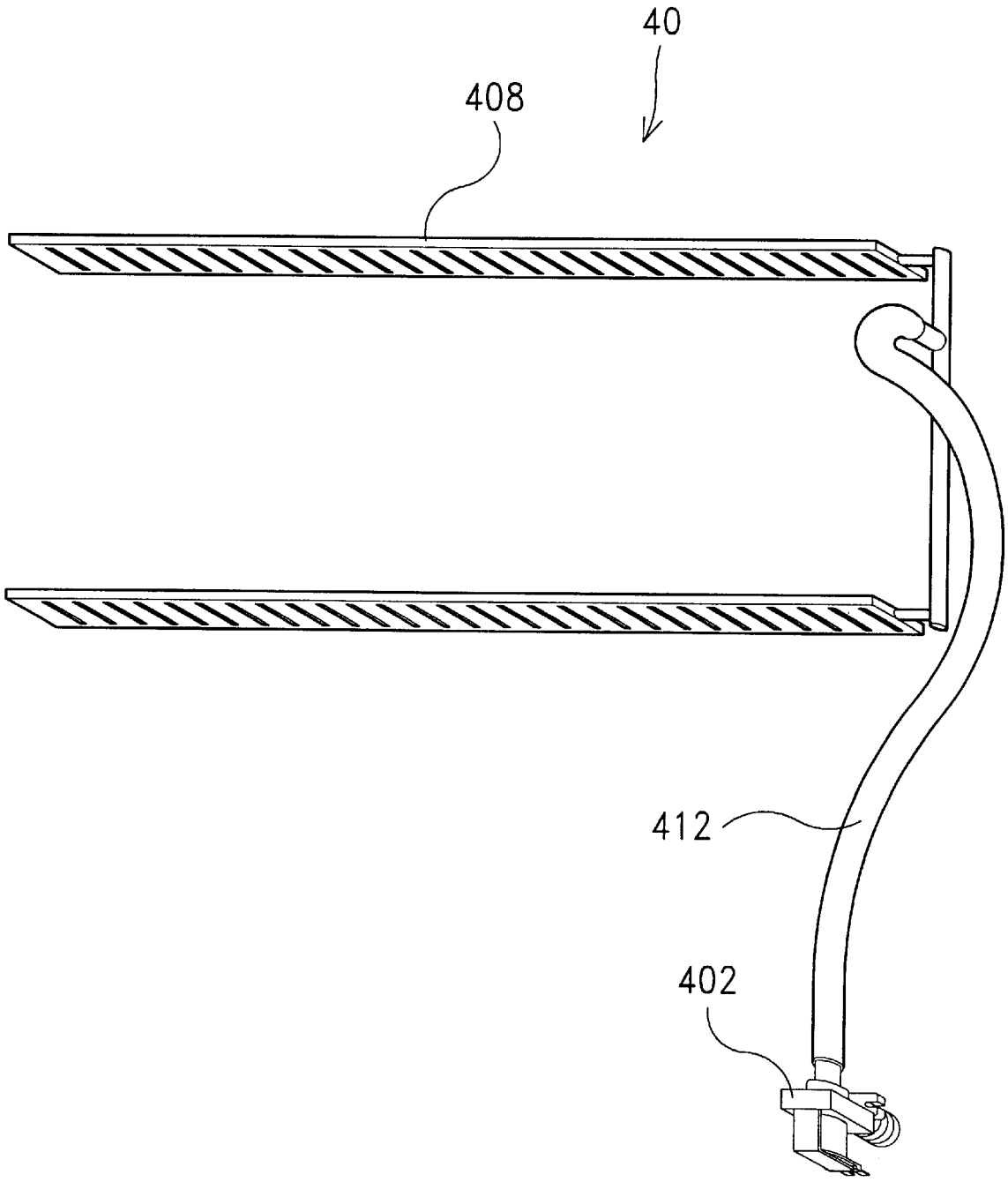
FIG. 10 is a schematic drawing showing the arrangement of the water spray tubes, water supply pipe and electromagnetic valve of the water supply system according to the present invention.

Referring to FIG. 10, the water spray tubes 408 can be round tubes or flat tubes. The water outlets of the water spray tubes 408 can be designed having a narrow elongated shape, or a circular shape. Each water spray tube 408 has a diameter gradually reducing from the water supply pipe 412 toward the end, so that cooling water can evenly be distributed to the evaporative condensing unit 20.

As indicated above, the evaporative condensing unit 20 is comprised of a plurality of condenser coils 204, each condenser coil 204 comprising a metal coil tubes 210 covered with a layer of absorptive material 202. When cooling water is delivered out of the water spray tubes 408 of the water supply system 40, it is absorbed by the absorptive material 202 of the condenser coil 204 and getting evaporated because of in contact with the metal coil tube 210 In high temperature for an evaporative heat exchange with the cooling medium passing through the metal coil tubes 210 of the condenser coils 204, and permitting heat to be quickly carried away by currents of air passing through the air gaps 212 in the evaporative condensing unit 20. Because the electromagnetic valve 402 of the water supply system 40 is controlled by the control PC board 404, the amount of cooling water supplied from the water supply system 40 to the evaporative condensing unit 20 in a predetermined period of time can be controlled approximately equal to the amount of water being evaporated in a proper intermittence automatically adjusted by the PC board 50, during the operation of the machine.

Figure 11:
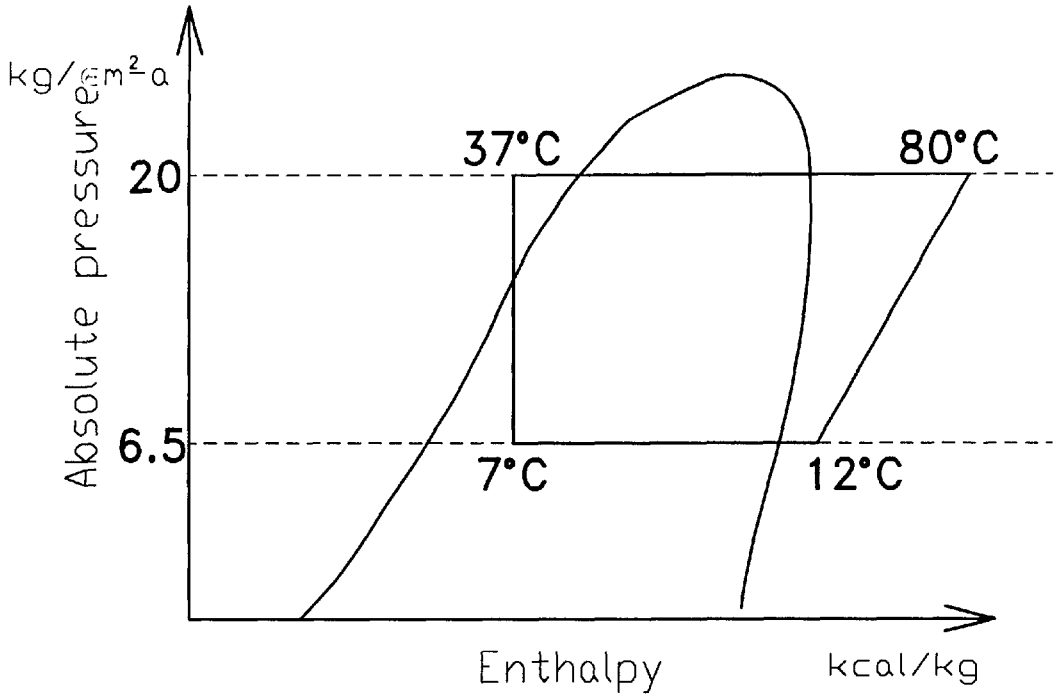
FIG. 11 is a R-22 Mollier diagram obtained from a conventional condenser unit.
Figure 12:
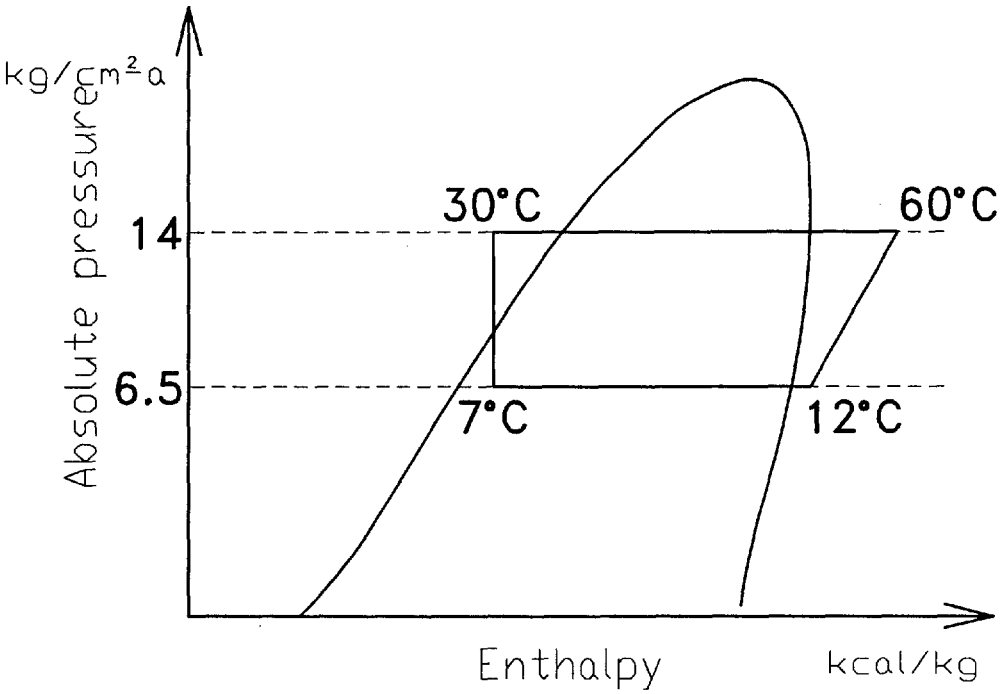
FIG. 12 is a R-22 Mollier diagram obtained from an evaporative condensing unit according to the present invention.

FIG. 11 illustrates a R-22 Mollier diagram obtained from a conventional condenser unit. FIG. 12 illustrates a R-22 Mollier diagram obtained from an evaporative condensing apparatus according to the present invention. In FIG. 9, the temperature of the gas state cooling medium at the input port of the condenser unit is about 80° C., the temperature of the liquid state cooling medium at the output port of the condenser unit is about 37° C., and the condensing pressure is about 20 kg/cm2-a. In FIG. 12, the temperature of the gas state cooling medium at the input port of the evaporative condensing apparatus is about 60° C., the temperature of the liquid state cooling medium at the output port of the evaporative condensing apparatus is about 30° C., and the condensing pressure is about 14 kg/cm2 -a (theoretically the condensing pressure if R-22 at 30° C. is about 12.27 kg/cm2-a, see FIG. 1). Because the compression pressure can be greatly reduced due to the temperature of the condensed cooling medium drops by about 7° C., therefore the efficiency is improved by about 20%. Because the compression pressure is greatly reduced, the consuming power of the compressor 10 can be reduced by about 25% in comparison with an equivalent conventional unit. Therefore, the evaporative condensing apparatus of the present invention can greatly reduce the power consumption of an air conditioner or refrigerator, and greatly improve its EER (or COP) value by about 50%. According to tests made on model RC870489, which is obtained from Shuan-Shih Electric Engineers Taiwan, at Air-conditioner Department of Hsu-lin Laboratory of Taiwan Power Research and Test Center, the EER value is as high as 4.027 kca/h.W (COP 4.68). In comparison with equivalent conventional devices, it saves power consumption by about 40%.

Figure 13:
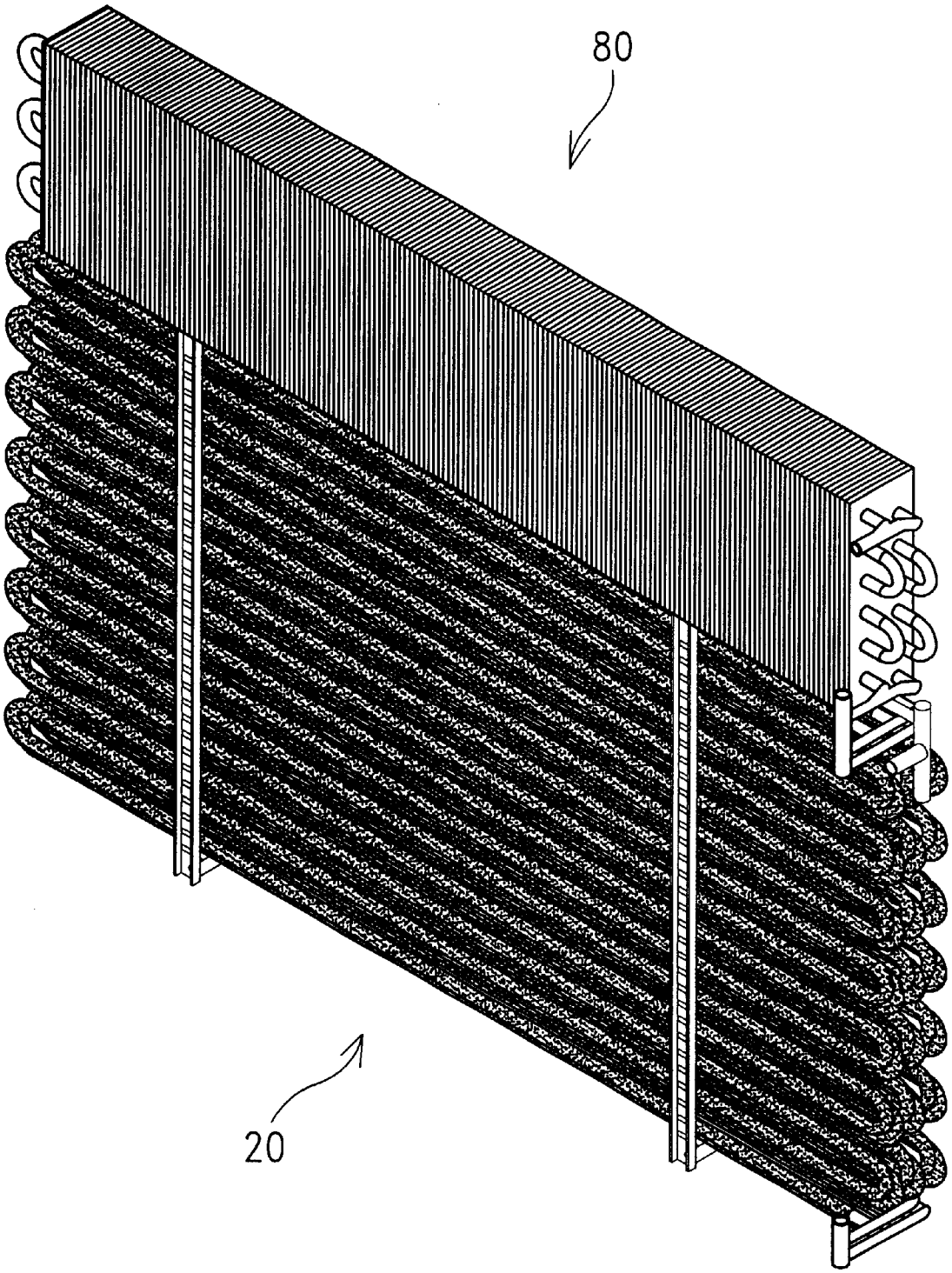
FIG. 13 is a perspective view of another embodiment showing a combination of condensing device according to the present invention.

Referring to FIG. 13, which the evaporative condensing unit 20 can be attached to a regular air cooling condenser 80 to form a combination of condensing device formed another embodiment of the present invention.

It is to be understood that the drawings are designed for purposes of illustration only, and are not intended as a definition of the limits and scope of the invention disclosed.

What the invention claimed is:

1. An evaporative condensing apparatus comprising:

an evaporative condensing unit for condensing a gas state cooling medium into a liquid state, said evaporative condensing unit comprising a plurality of condenser coils having a layer of absorptive material covered thereon;

an intermittent water supply system having a control PC board and an electromagnetic valve controlled by said control PC board to let cooling water be delivered intermittently from a water source to said layer of absorptive material of each of said condenser coils of said evaporative condensing unit;

a compressor controlled to pump a gas state cooling medium into said evaporative condensing unit; and to condence gas state medium into liquid state thereat;

a condenser fan having a fan motor and a fan blade unit driven by said fan motor to draw currents of air through gaps in said condenser coils of said evaporative condensing unit in carrying evaporated moisture and heat away from said evaporative condensing unit.

2. The evaporative condensing apparatus of claim 1 wherein said control PC board comprises a piano switch for setting a period of time for water supplying from 1 second to 15 seconds, a select switch having an "auto" position for normal operation and a "cont."(continuous) position only used to clean said condencing unit for maintenance, a thermal sensor for detecting temperature of said cooling medium in said condensing coils, and a CPU unit for processing to select a predetermined regular intermittence or a reduced substitutional intermittence of said intermittent water supply system automatically according to a temperature signal fed back from said thermal sensor in compare with a setting temperature, and automatically to control said electromagnetic valve therefore.

3. The evaporative condensing apparatus of claim 1 wherein said water supply system further comprises a water supply pipe having a water input end connected to said electromagnetic valve and a water output end, and plurality of water spray tubes respectively connected to the water output ends of said water supply pipe for guiding cooling water to said condenser coils, said water spray tubes each having a diameter gradually reduced from said water supply pipe, a plurality of water outlets respectively facing said condenser tubes, and an absorptive material provided at said water outlets.

4. The evaporative condensing apparatus of claim 1 wherein said evaporative condensing unit comprises at least one supporting frame, which supports said condenser coils, and at least one packing frame fastened to said supporting frame to hold said condenser coils in place.

5. The evaporative condensing apparatus of claim 4 further comprising an air cooling radiating fin type condensing unit attached to said evaporative condensing unit.

6. The evaporative condensing apparatus of claim 4 wherein said condenser coils each comprise a metal coil tube and a layer of absorptive material covered on the periphery of said metal coil tube.

* * * * *